US005408946A

United States Patent [19]

Jones et al.

[11] Patent Number: 5,408,946

[45] Date of Patent: Apr. 25, 1995

[54] MARINE VEHICLE MOORING AND SECURITY DEVICE

[76] Inventors: Peter J. Jones; Paul R. A. Jones, both of R.R. #1, Puslinch, Ontario N0B 2J0; Gerritt Ottema, 191 McCrurdy Road, Guelph, Ontario N1H 6L3, all of Canada

[21] Appl. No.: 133,929

[22] Filed: Oct. 12, 1993

[51] Int. Cl.[6] ..... B63B 21/00

[52] U.S. Cl. ..... 114/230

[58] Field of Search ..... 114/77 R, 249, 250, 114/230, 221 R

[56] References Cited

U.S. PATENT DOCUMENTS 2,456,839 12/1948 Princell ..... 114/230
2,526,162 10/1950 Schuelke ..... 114/230
2,569,783 10/1951 Smith ..... 114/230
3,019,759 2/1962 Woods ..... 114/230
3,064,615 11/1962 Waltman ..... 114/230
3,177,838 4/1965 Grimes ..... 114/230

*Primary Examiner*—Stephen P. Avila
*Attorney, Agent, or Firm*—R. Craig Armstrong

[57] ABSTRACT

A marine vehicle mooring and security device comprising bow and stern securing mechanisms connected to a mooring structure on one end and to existing boat hardware at the other. The securing mechanisms include extension arms and a secondary support member bracing at least one of the bow or stern extension arms, and an attachment apparatus to connect the securing mechanisms to a marine vehicle. Damping for both tensile and compressive forces is provided in the secondary support member by way of an elastic element.

4 Claims, 10 Drawing Sheets

MARINE VEHICLE MOORING AND SECURITY DEVICE

BACKGROUND OF THE INVENTION

1. Field of the Invention

This invention relates to a marine vehicle mooring and security device, and in particular to a device for securing marine vehicles to a docking structure while protecting them from collision or impact with that structure as a result of waves or inclement weather. The device also reduces the possibility of theft.

2. Description of the Prior Art

The mooring of marine vehicles to docks or piers has usually been accomplished by means of ropes or stay lines. The problem with ropes and lines is their ability to support only tensile forces. The inability to support compressive forces restricts their usefulness and may require marine vehicles or docks to be equipped with elastic bumpers or the like. Alternatively, an arrangement permitting line fastening on both the port and starboard sides of the marine vehicle may be necessary to avoid excessive collision between the vehicle and the dock. This would require a docking slip or other set up to which both sides of the vehicle can be attached. This type of configuration is not always available. Even with such a configuration, lateral motion is still not completely restricted due to the elastic nature of the ropes or lines. The fastening of additional ropes or stay lines to help restrict this motion would add considerable time to the docking procedure.

In the past, numerous types of boat mooring devices have been proposed such as those described in U.S. Pat. Nos. 4,250,827, 4,627,375 and 4,686,926. Each of these devices utilize two similar attachment bars placed between a side of the boat and a fixed mooring structure. These devices include means to pivot vertically to accommodate changing water levels, as well as some type of spring or shock absorbers that provide motion damping.

These prior art devices however, require the installation of additional retrofit hardware on one or both sides of a boat. Also, these earlier devices do not restrict lateral motion very well. Furthermore, the prior art devices do not provide a means for locking the marine vehicle with a padlock or similar device. Generally, the prior art devices are inadequate to provide suitable convenience or security in mooring a marine vehicle. Thus, there is a need for affordable, simple and versatile marine vehicle mooring devices that provide convenience and security to the docking procedure.

SUMMARY OF THE INVENTION

It is therefore an object of the invention to provide a boat mooring device that will allow a marine vehicle to be moored quickly and easily while still providing means to reduce or eliminate damage to the vehicly due to collision with fixed mooring structures (dock).

It is a further object of the invention to provide a boat mooring device that requires no additional retrofit boat hardware to complete the installation.

It is a further object of the invention to provide a boat mooring device that provides a means to lock the boat, thereby discouraging theft attempts.

In the invention, there is provided a boat mooring device comprising first and second arms adapted to be fitted between a dock and a boat, the first arm being adapted to extend from the dock to a first attachment bracket proximate the bow of the boat and the second arm being adapted to extend from the dock to a second attachment bracket proximate the stern of the boat, both arms being horizontally and vertically pivotable relative to the dock, the device also having a lateral position stabilization ele- ment vertically pivotable relative to the dock and extending between the dock and at least one of the arms for limiting movement of the boat along the dock, the stabilization ele- ment comprising first and second struts constrained to move axially in-line, an elastic element connecting the two struts causing the aggregate length of those struts to return to a normalized value after being stretched or compressed.

The present invention is designed to allow the extension arms to be adjusted to different lengths for various boat sizes, and simultaneously rotate around the attachment point in both the horizontal and vertical planes. The invention is also fitted with a bow and stern damping system. These features provides flexibility and motion damping to the marine vehicle in changing water levels or rough water caused by inclement weather.

The attachment apparatus integrated into the invention makes use of the marine vehicle's existing hardware. A great number of recreational boats are provided with hardware at both the front and the rear of the boat to allow the securing of trailer tie down straps. Typically, one fitting is provided near the bow underneath the deck and along the centerline, while two additional identical fittings are provided on the transom on either side of the motor placement area. The attachment apparatus also has the ability to be operated remotely by means of a pull cord and may be locked from undesired use by means of a padlock or the like.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
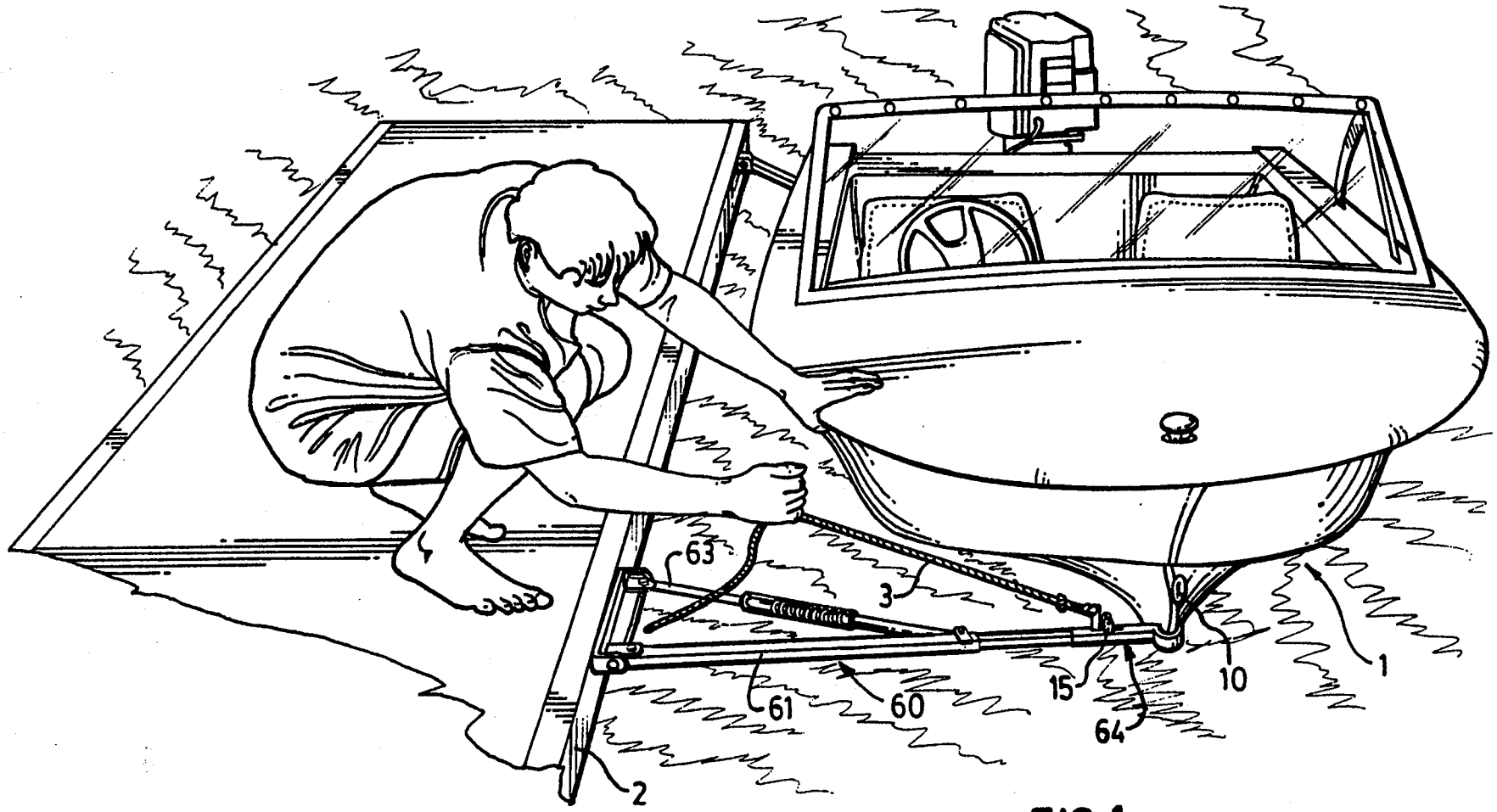
FIG. 1 is a perspective view showing a boat moored using the device.
Figure 2:
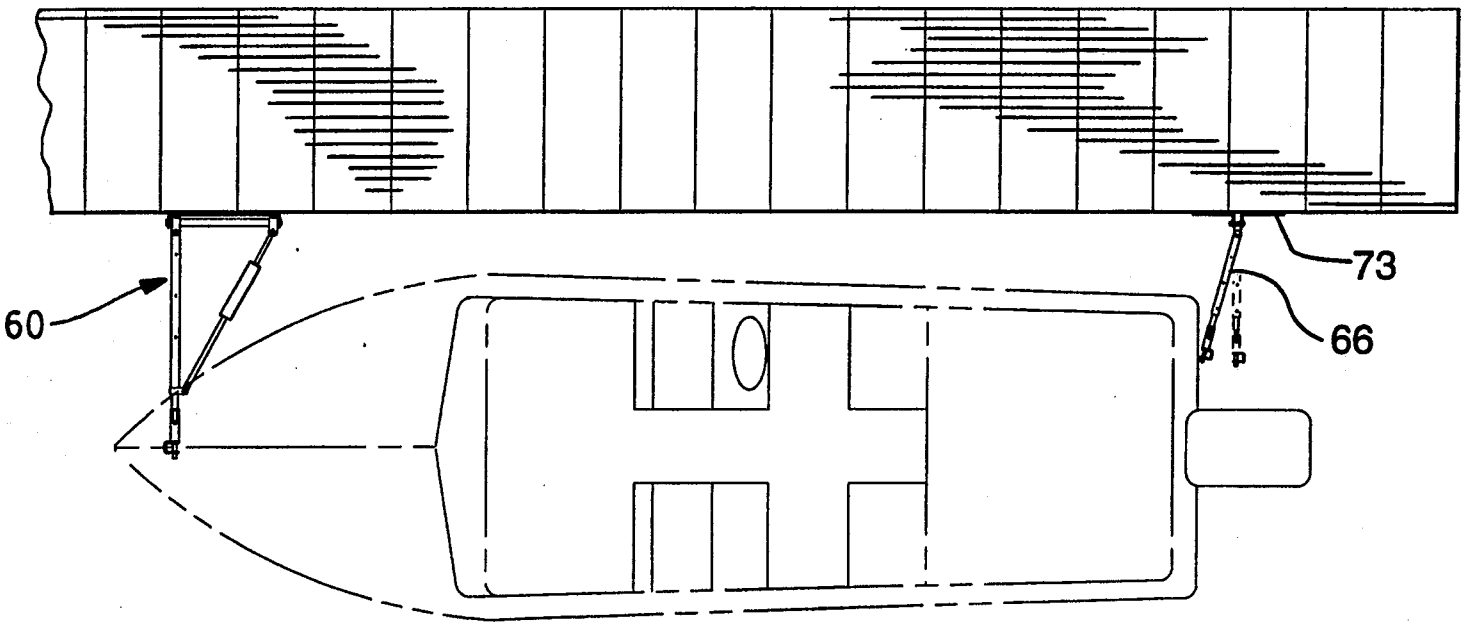
FIG. 2 is a top plan view showing a boat moored using the device.

Referring to FIGS. 1 and 2, it can be seen that the marine vehicle mooring and security device is comprised of two distinct components. The bow securing mechanism 60 of the device attaches to a corresponding attachment eyelet or fairlead 10 commonly found at the bow of a boat. The stern securing mechanism 66 attaches to one of two corresponding stern eyelets or fairleads 20 commonly found on the port and starboard sides at the stern of boats as shown on FIG. 4.

Figure 3:
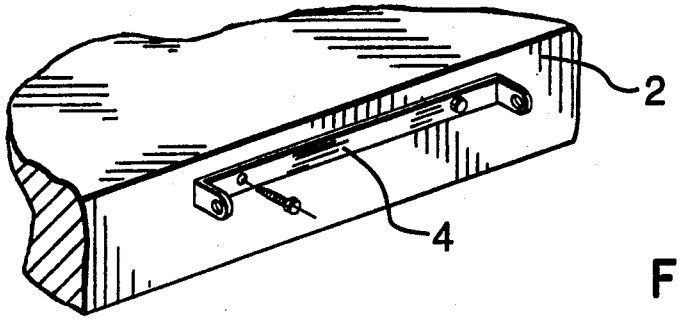
FIG. 3 is a perspective view of one embodiment of the dock connection means for the bow securing mechanism.

The bow securing mechanism 60 as seen in FIGS. 1 and 3, is comprised of several main elements, being a base plate 4, an extension arm 61, a secondary support strut 63, and a spring loaded pin clip 64.

The base plate mounting bracket 4 as seen in FIG. 3, is attachable to the side or surface of any fixed mooring structure such as a dock 2 by means of bolts, screws, clamps or the like. A pinned shaft 41 is pivottably attached to the base plate 4 by means of two rotation pins 13 creating a horizontal axis. Rigidly attached to each end of the pinned shaft 41 are attachment brackets 54. These brackets allow a pinned connection with the extension arm 61 and the secondary support strut 63 by means of vertical attachment pins 53. The pinned shaft 41 and the vertical attachment pins 53 allow simultaneous rotation in both the vertical and horizontal planes. Movement in both directions is shown in FIGS. 5, 12, 13 and 19.

Figure 14:
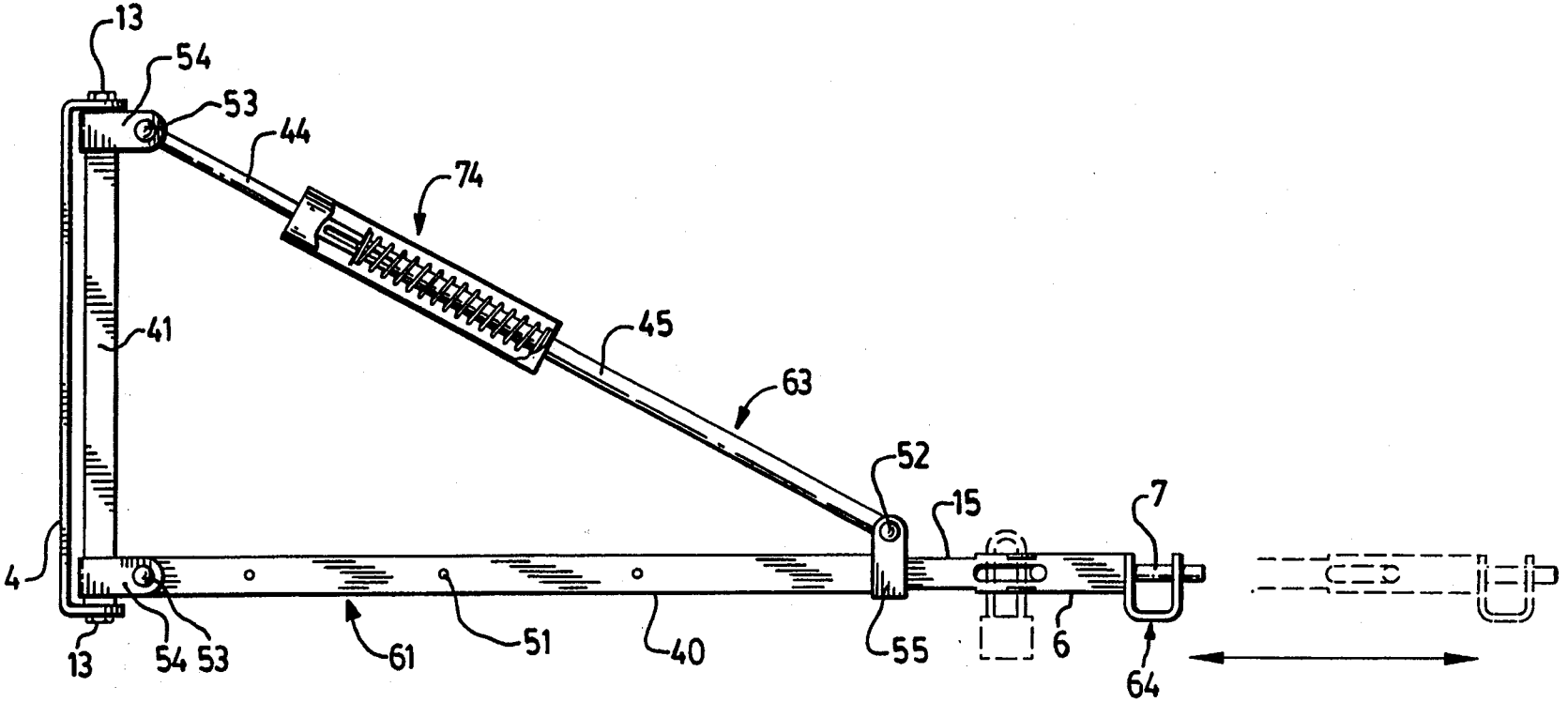
FIG. 14 is a top view of the front securing mechanism showing the adjustability for different boat sizes.
Figure 15:
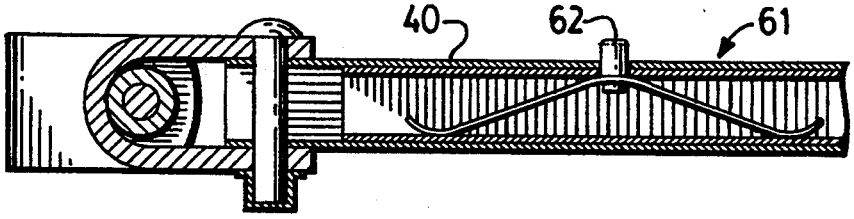
FIGS. 15–16 are partial sectional views of the rear securing mechanism showing adjustability to different boat sizes.
Figure 16:
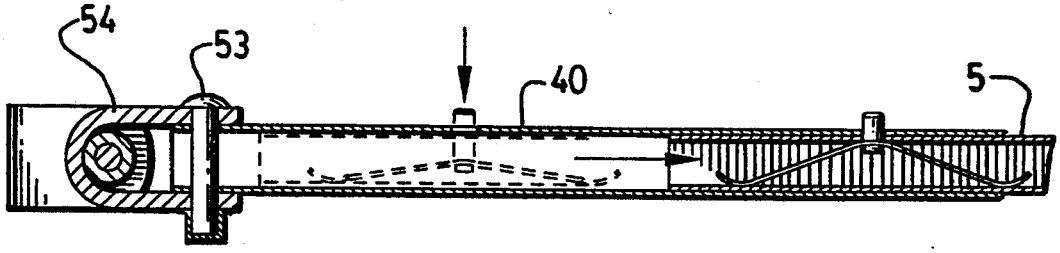

As seen in FIGS. 14–16, the extension arm 61 is comprised of two compatible square tubes. The external tube 40 connects directly to the attachment bracket 54 by means of the attachment pin 53 and slidably receives the internal tube 5. Along the length of the external tube 40, there is placed a plurality of spaced diametrical holes 51. The holes are manufactured so as to accommodate a spring loaded adjustment pin 62 located on the slidably accepted end of the internal tube 5. The spaced diametrical holes provide the telescopic adjustment while the spring loaded adjustment pin 62 locks the two tubes in place once a suitable length has been chosen. Rigidly attached to the further most end of the external tube 40 is the secondary support strut attachment bracket 55.

The secondary support strut 63 as seen in FIG. 1, is comprised of an inner strut shaft 44 and an outer strut shaft 45 flexurally connected by means of a damping system 74. Each shaft is manufactured from square tubing. The inner strut shaft connects directly to the attachment bracket 54 by means of an attachment pin 53. The outer strut shaft 45 connects directly to the attachment bracket 55 by means of a vertical attachment pin 52. The secondary support strut 63 provides a diagonal connection between the extension arm 61 and the base plate mounting bracket 4. The link between the inner and outer struts will become apparent with the description of the operation of the damping system 74.

The damping system 74 can be seen in greater detail from FIGS. 6–11. The damping system encasement chamber 47 contains a single spring 57. The spring 57 is situated between the chamber end 49 and a washer 48 backed by a roll pin 59 contained in the roll pin guide slot 58 machined through both the inner and outer strut shafts 44 and 45. The inner strut shaft 44 slidably receives the outer strut shaft 45 while spacer sleeve 46 ensures proper centering and maintains the sliding action within the encasement chamber 47.

In operation, damping of both compressive and tensile forces is accommodated. During a compressive force, the roll pin 59 will position itself at the outer most end of the roll pin guide slot machined in the inner strut shaft 44 and at the inner most end of the roll pin guide slot machined in the outer strut shaft 45. At this point, the spring 57 will begin to compress providing compressive damping. During a tensile force, the roll pin will position itself at the inner most end of the roll pin guide slot machined in the inner strut shaft 44 and at the outer most end of the of the roll pin guide slot machined in the outer strut shaft 45. At this point, the spring will again begin to compress providing tensile damping.

Figure 17:
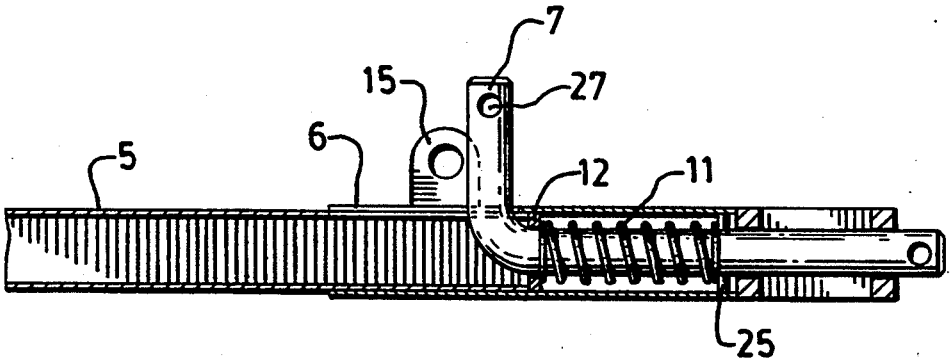
FIGS. 17–18 are part sectional views of the front securing mechanism showing movement of the locking clip.
Figure 18:
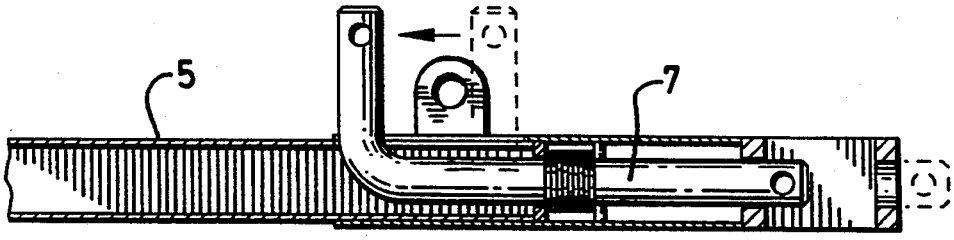
Figure 19:
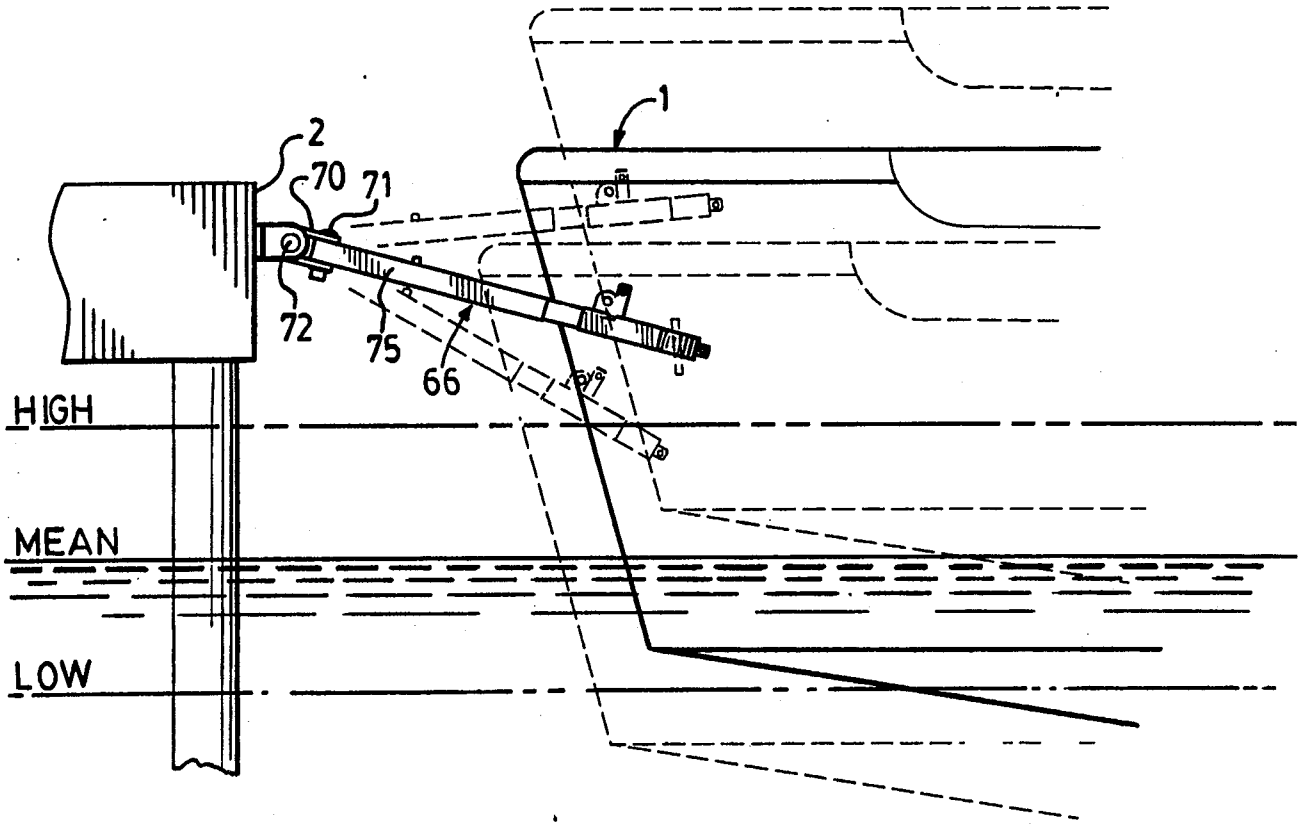
FIG. 19 is a side view showing the response to vertical motion of the boat.

The spring loaded pin clip 64, as seen in detail in FIGS. 14, and 17–18 attaches rigidly onto the extended end of the internal tube 5 of the extension arm 61. The spring loaded pin clip 64 is comprised of a latching mechanism encasement 6 formed from a section of square tubing and a U-shaped clip 8 with a latch pin guide hole. The retractable latch pin 7 is formed from a section of round bar with a 90 degree bend at one of its ends to create a handle to manipulate the latch pin 7. The latch pin 7 is held in place by means by a retaining washer 12 and a spring 11 placed inside the latching mechanism encasement 6. A spring pin 25 provides the spring with sufficient locking tension. A padlock securing post 15 is attached rigidly behind the handle of the latch pin 7 to prevent any undesired manipulation. The handle of the latch pin 7 is fitted with a latch pin attachment hole 27 to allow for the connection of a rope 3 or the like for the purpose of manipulating the latching mechanism remotely.(see FIG. 1)

Referring again to FIG. 1, in operation, the handle of the latch pin 7 may be opened remotely and brought in contact with the eyelet or fairlead 10 located at the bow of the boat 1. Once the spring loaded pin clip 64 is strategically positioned around the eyelet, the handle of the latch pin 7 may be released locking the device to the vehicle. If added security is desired, a padlock or combination lock may now be inserted through the padlock securing post 15.

Figure 4:
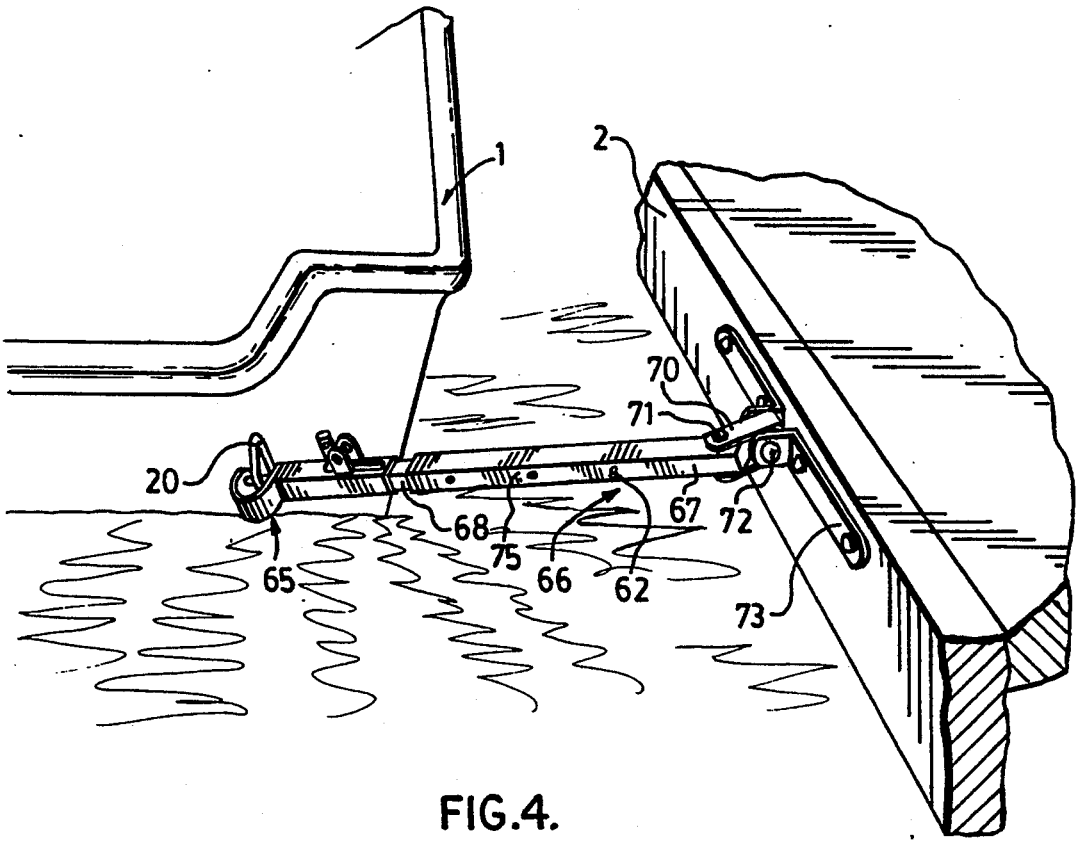
FIG. 4 is a perspective view of the rear securing mechanism shown attached to a boat.
Figure 6:
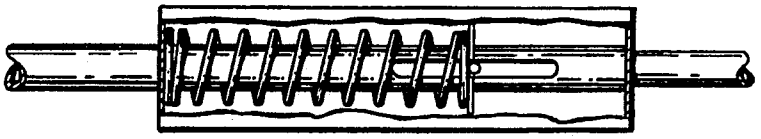
FIG. 6 is a side view of the damping system with the outer casing removed.
Figure 7:
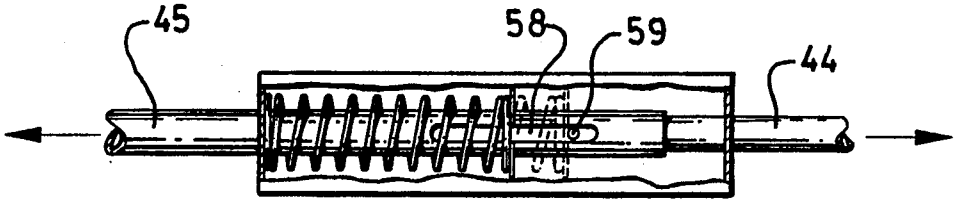
FIGS. 7–8 are side views of the damping system with the outer casing removed showing movement in response to both tensile and compressive forces.
Figure 8:
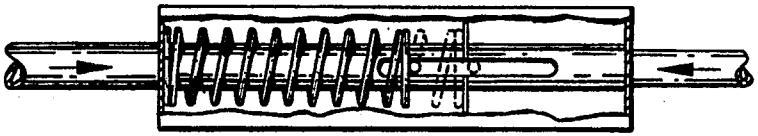
Figure 5:
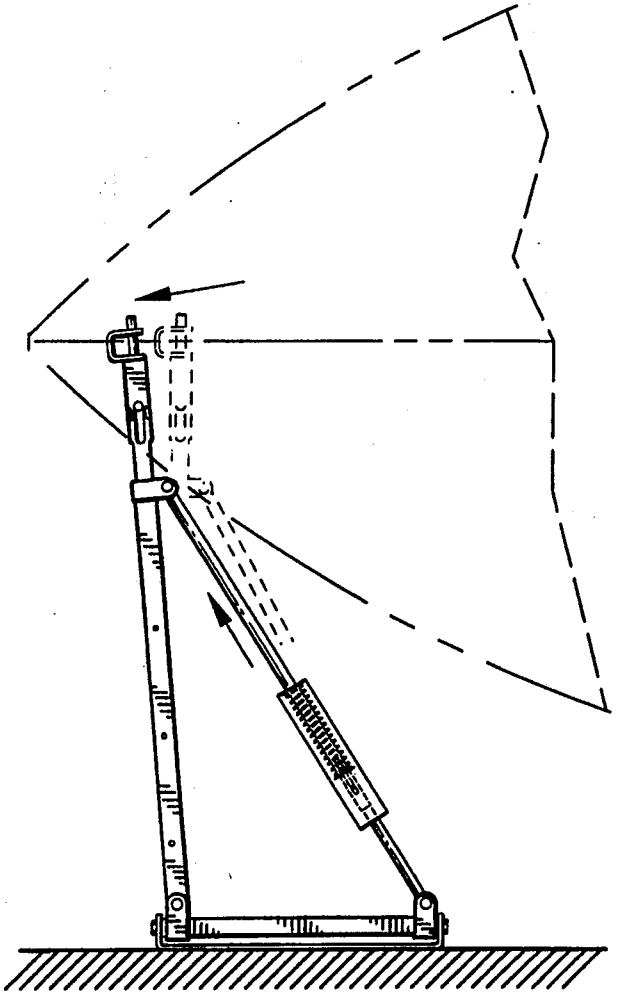
FIG. 5 is a top view showing the response of front securing mechanism to horizontal motion of the boat.
Figure 9:
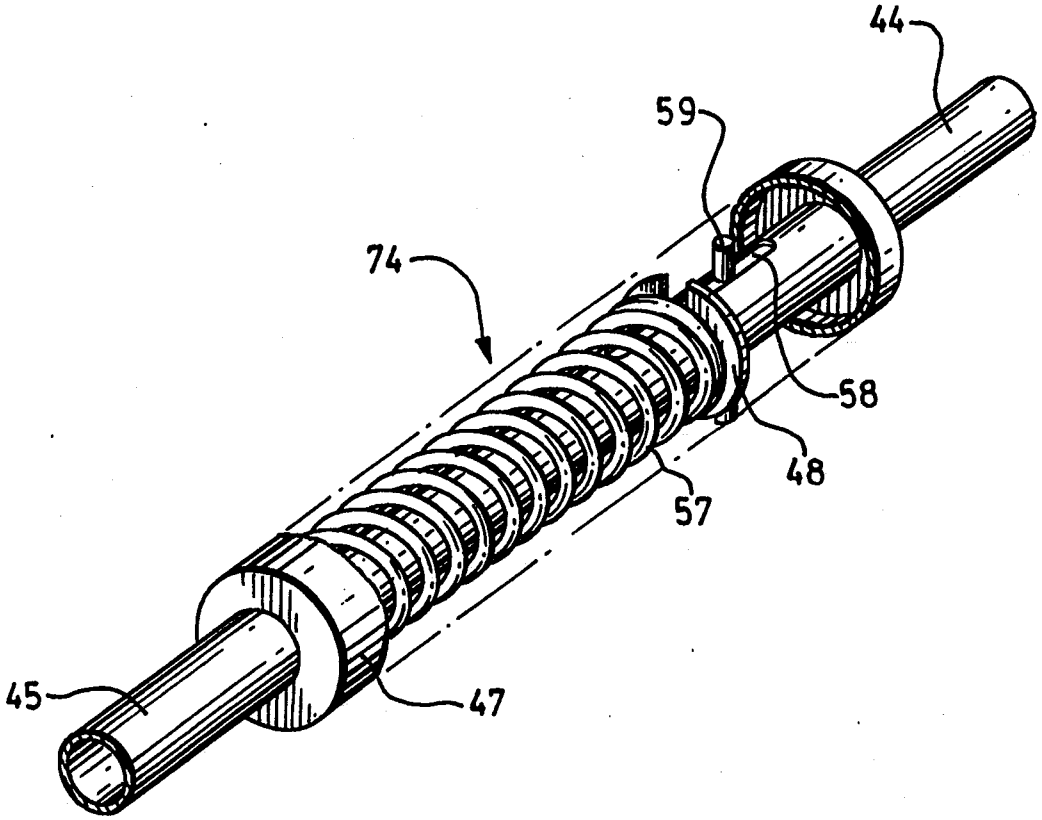
FIG. 9 is a perspective view of the damping system.
Figure 10:
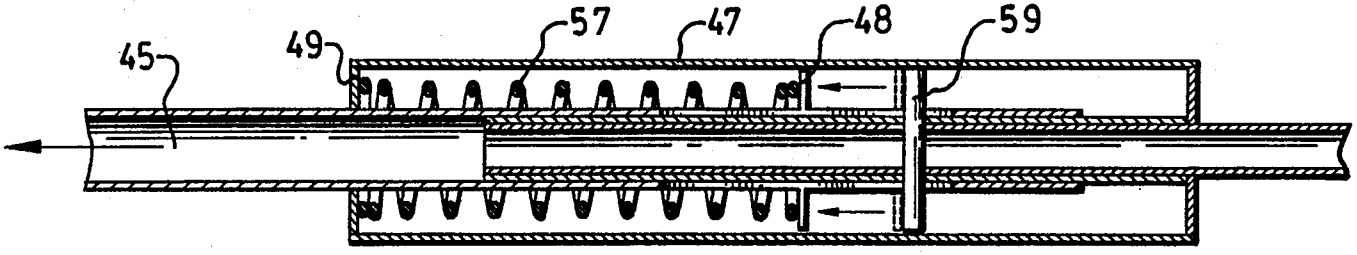
FIGS. 10–11 are sectional views of the damping system showing movement in response to both tensile and compressive forces.
Figure 11:
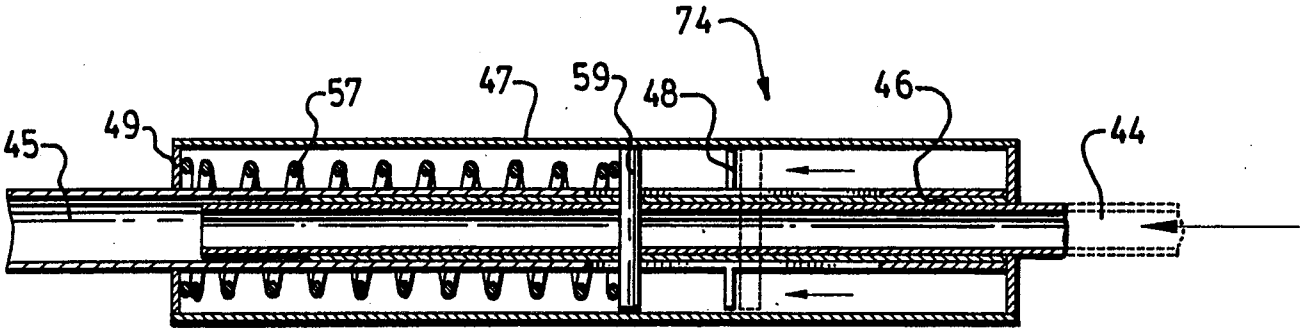
Figure 12:
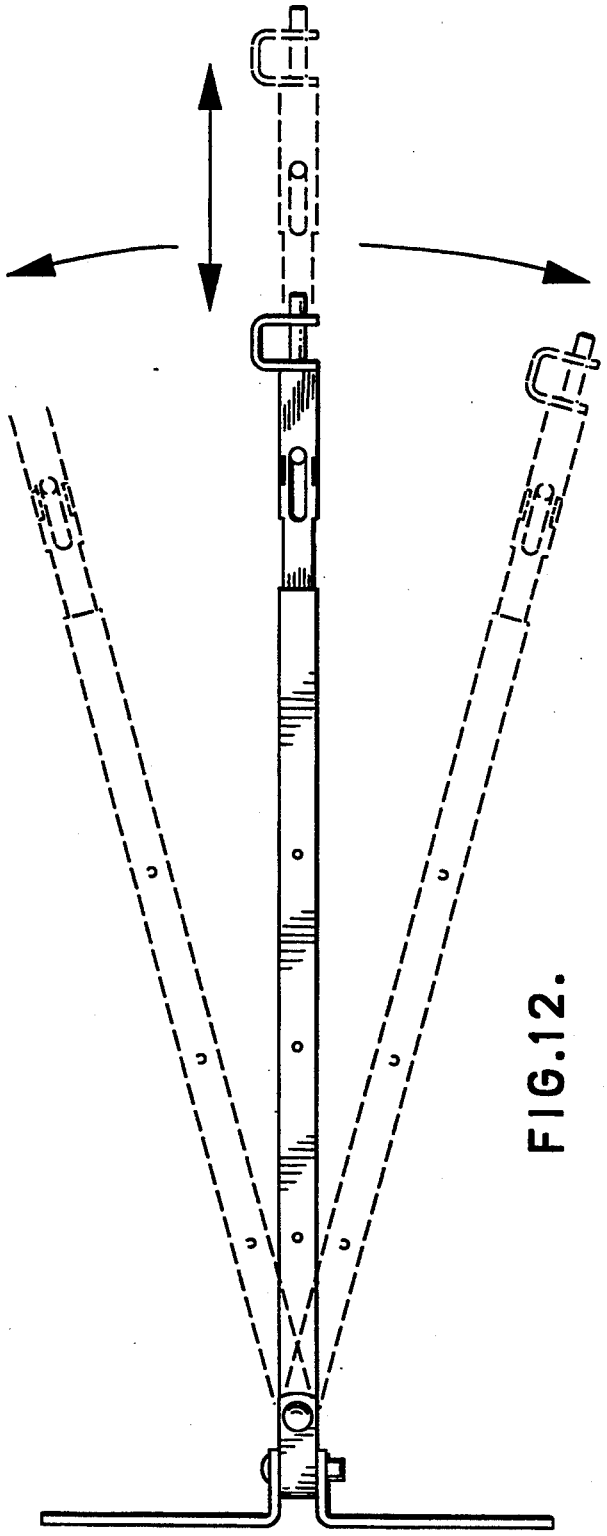
FIG. 12 is a top view of the rear securing mechanism showing range of horizontal movement.
Figure 13:
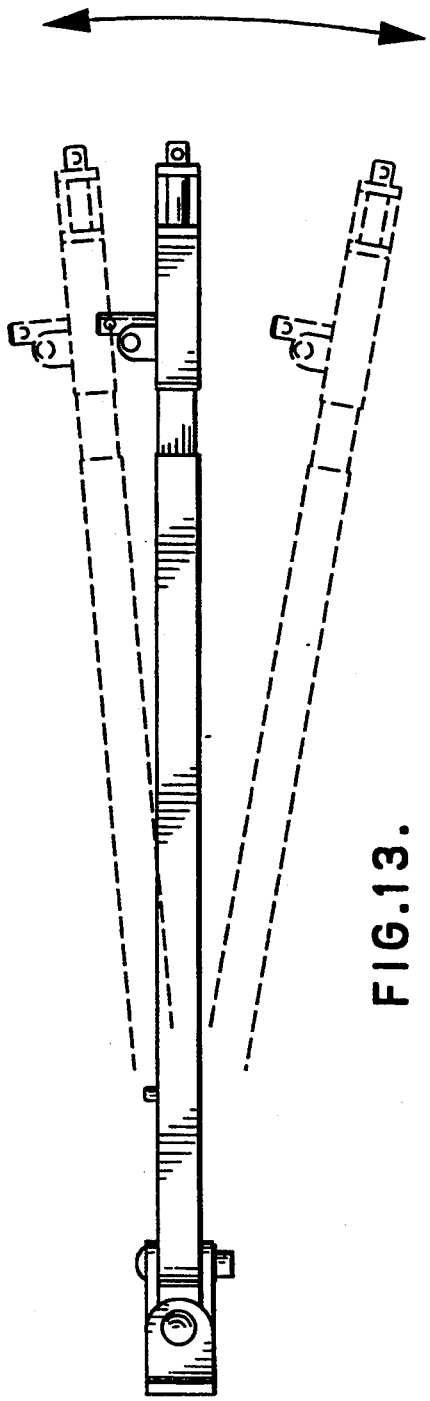
FIG. 13 is a side elevational view of the front securing mechanism showing range of vertical motion.

The stern securing mechanism 66 as seen in FIG. 4, is comprised of many similar elements as the bow component 60. The stern component 66 can be divided up into a base plate mounting bracket 73, an extension arm 75, and a spring loaded pin clip 65.

The base plate mounting bracket 73 as seen in FIG. 4, is attachable to the side or surface of any fixed mooring structure such as a dock 2 or the like by means of bolts, screws, clamps or the like. A rotating arm attachment bracket 70 is pinned to the base plate mounting bracket 73 by means of a vertical attachment pin 72. The external tube 67 of the extension arm is pinned to the rotating arm attachment bracket 70 by means of a horizontal attachment pin 71. The vertical attachment pin and the horizontal attachment pin allow simultaneous rotation in both the horizontal and vertical planes respectively. The external tube 67 and the internal tube 68 are flexurally connected by means of the adjustment pin 62. The further most extended portion of the internal tube 68 is rigidly fitted with a spring loaded pin clip 65 which is identical to the spring loaded pin clip 64 described above. The operation of the latch pin is as described for the bow securing mechanism 60.

In operation, a boat may be subjected to forces due to wind, waves or users stepping in or out of the boat. With the bow and stern securing mechanisms attached, these forces are transmitted through the boat to the securing arms. Damping of these forces in the horizontal plane is accomplished by the damping mechanism normally attached to the bow arm. The damping mechanism can accomodate both tensile and compressive forces, thereby effectively keeping the boat in the same position, and preventing damage to it from rubbing or banging into the dock. Thus lateral stabilization is accomplished. Vertical stabilization is provided by the damping effect of the water.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A boat mooring device comprising first and second arms adapted to be fitted between a dock and a boat, the first arm being adapted to extend from the dock to a first attachment bracket proximate the bow of the boat and the second arm being adapted to extend from the dock to a second attachment bracket proximate the stern of the boat, both arms being horizontally and vertically pivotable relative to the dock, the device also having a lateral position stabilization element vertically pivotable relative to the dock and extending between the dock and at least one of the arms for limiting movement of the boat along the dock, the stabilization element comprising first and second struts constrained to move axially in-line, an elastic element connecting the two struts, said elastic element being capable of resisting both compression and extension such that the aggregate length of the two said struts can increase or decrease in response to external forces, and further said elastic element being normally biased to thereafter return the aggregate length of the two said struts to a normalized value, wherein each of the first and second attachment brackets are the mooring brackets which are normally present on and integral with the boat, and wherein an outer end of each arm houses a pin biased to assume a first longitudinal position on the arm, the pin on each arm being adapted to extend through a respective one of the brackets to secure the arm to the boat.

2. A boat mooring device as in claim 1, wherein the elastic element is a spring.

3. A boat mooring device as in claim 1, wherein the length of the first and second arms is adjustable.

4. A boat mooring device as in claim 1, wherein a rope is provided to operate at least one of said pins to assist a user in attaching or releasing said at least one arm from the boat.

* * * * *